US005600901A

United States Patent [19]

Leonor

[11] Patent Number: 5,600,901

[45] Date of Patent: Feb. 11, 1997

[54] SPIKE CONVERTIBLE SPORT SHOES

[76] Inventor: Freddie D. Leonor, 87-712 Manuaihue St., Waianae, Hi. 96792

[21] Appl. No.: 286,156

[22] Filed: Aug. 4, 1994

[51] Int. Cl.[6] ..... A43B 3/16

[52] U.S. Cl. ..... 36/7.1 R; 36/105; 36/127

[58] Field of Search ..... 36/89, 7.1 R, 7.7, 36/7.6, 105, 127, 134

[56] References Cited

U.S. PATENT DOCUMENTS

| | | | |
|---|---|---|---|
| 1,195,866 | 8/1916 | Stephan . | |
| 1,428,123 | 9/1922 | Steele . | |
| 1,493,322 | 5/1924 | Carter et al. . | |
| 1,689,000 | 10/1928 | Wagner | 36/50.1 |
| 1,728,469 | 9/1929 | Bianco et al. . | |
| 1,749,522 | 3/1930 | Wedig . | |
| 1,763,997 | 6/1930 | Williams | 36/50.1 X |
| 1,902,521 | 3/1933 | Rice . | |
| 2,006,802 | 7/1935 | Goodman | 36/7.7 |
| 2,118,778 | 5/1938 | Hart | 36/62 |
| 2,409,813 | 10/1946 | Timson | 36/105 X |
| 2,745,197 | 5/1956 | Holt | 36/2.5 |
| 3,019,533 | 2/1962 | Smith | 36/7.6 |
| 3,075,307 | 1/1963 | Becker | 36/7.7 |
| 3,142,911 | 8/1964 | Waters | 36/105 X |
| 3,559,310 | 2/1971 | Kiela | 36/127 |
| 3,597,863 | 8/1971 | Austin | 36/127 X |
| 3,643,352 | 2/1972 | Adair | 36/7.3 |
| 3,914,882 | 10/1975 | Greer | 36/62 |
| 4,010,558 | 3/1977 | Slusher | 36/7.3 |
| 4,299,037 | 11/1981 | Carey | 36/7.6 |
| 4,649,939 | 3/1987 | Curtis | 36/89 |
| 4,702,021 | 10/1987 | Cameron | 36/62 |
| 4,969,277 | 11/1990 | Williams | 36/105 X |
| 5,056,240 | 10/1991 | Sherrill | 36/7.3 |
| 5,259,129 | 11/1993 | Deacon et al. | 36/127 |
| 5,384,971 | 1/1995 | Ferry | 36/105 |

*Primary Examiner*—Ted Kavanaugh

*Attorney, Agent, or Firm*—Skjerven, Morrill, MacPherson, Franklin & Friel; Thomas E. MacDonald

[57] ABSTRACT

An attachment for converting a non-spiked dress or sport shoe to a spiked shoe for golfing or other walking or running activities includes two clam-shell like attachment halves which are pivotable so as to mountable against the sides and bottom of an underlying shoe. The attachment has a longitudinally-extending slitted upper and vertically-extending slitted heel both of which mount suitable fastener elements such as hoops and loops (Velcro®-type) elements or snap-on buttons or a lacing and eyelet fastener or a zipper fastener. After the attachment is pivotally opened up in the manner of a clam shell, the attachment is placed about the bottom and sides of the non-spiked dress or sports shoe on the user's foot and the fastener(s) cinched up to securely hold the attachment on the underlying shoe so that there is essentially no relative movement therebetween, when the user is walking or engaging in his or her golf swings.

1 Claim, 3 Drawing Sheets

SPIKE CONVERTIBLE SPORT SHOES

FIELD OF THE INVENTION

The present invention relates to an attachment or add-on to a dress or sport shoe which converts a pair of such shoes to spiked shoes. More particularly, the invention is directed to an easily added and removable attachment containing spikes for converting a non-spike dress or sport shoe to a spiked golf shoe.

BACKGROUND OF THE INVENTION

Shoe attachments which afford additional traction have been known for years. Most of these include spikes which prevent slipping on ice or hard snow. Some merely have a toe portion with bottom spikes which portion is inserted over the toe of a dress or sport shoe and held thereon by flexible heel straps somewhat like half-rubbers. These are exemplified by U.S. Pat. Nos. 1,195,866; 1,428,123; 1,728,469; 1,902,521; 2,718,778; and 3,075,307. Other constructions use straps with projections which fit under the shoe sole as seen in U.S. Pat. Nos. 1,749,522; 2,006,802; 1,493,322; 3,019,533; 3,914,882; and 4,702,021. Several of these constructions have been for golf purposes. These prior art attachments generally suffer from a common fault, namely, relative movement of the attachment to the underlying shoe, when the user is involved in an activity where substantial stress is placed on the shoe and the attachment. Most of the prior art shoe attachments are for walking gingerly on slippery ice or the like where there is no twisting or weight shifting of the user and not where relative movement of the underlying shoe and the attachment must be prevented, i.e. the attachment must be made tight against the underlying shoe. Further, the attachments of the prior art have constructions which are not aesthetically pleasing. While they are somewhat practical for anti-ice sliding, they do not meet the performance and fashion standards of the modern golfer.

SUMMARY OF THE INVENTION

The present invention meets a need of a golf or other sport shoe attachment which more closely looks like and performs as an ordinary golf or sports shoe and which is easily convertible from a dress shoe mode to a spike shoe mode or vice versa. This allows a golfer or sportsman to quickly and firmly "slap-on" and "cinch-up" a spike-containing attachment and to remove the attachment when the golf round is finished or when it is needed to go into a "NO SPIKES" area of a golf clubhouse or its environs, such as dangerous concrete steps or pool areas or synthetic grass practice areas. A pair of such attachments are lightweight and can be included in a handbag, golf bag or luggage while travelling thus dispensing with the need of packing a pair of regular relatively heavy golf shoes.

The shoe attachment of the invention includes a flexible sole including an integral heel portion, each normally made of nylon or other plastic material and each mounting an array of golf or other spikes. "Spikes" as used herein means either the normal spikes seen on golf shoe soles or more flat buttons or knobs or molded-in-place or otherwise attached sole protuberances. For example, the shoe attachment of the invention can take the form of a job site shoe attachment where a work-inspecting visitor may quickly slap-on the attachment with flat molded buttons on the sole button, so that he or she can protect their dress shoes and more safely traverse the mud, or slush, or dirt associated with a normal job site.

An integral clam-shell upper extends from the sole and heel portion and is slitted vertically at the rear of the heel portion and slitted longitudinally at a top instep portion, the slits allowing the attachment to be opened longitudinally and angularly and easily placed over the underlying dress or non-spiked sport shoe so as to essentially envelop all of the entire underlying shoe exterior. Closures are provided at the edges of both slits. After the attachment is mounted on the underlying shoe the closures are cinched-up to tighten both the sole of the attachment against the flat underside of the non-spike shoe and the upper of the attachment against the upper of the non-spike shoe. The attachment may be made in a size to accommodate several sizes and widths of the underlying shoe due to use, particularly of hook and loop fasteners, which close and cinch-up the closures over a relatively wide range.

DETAILED DESCRIPTION

Figure 1:
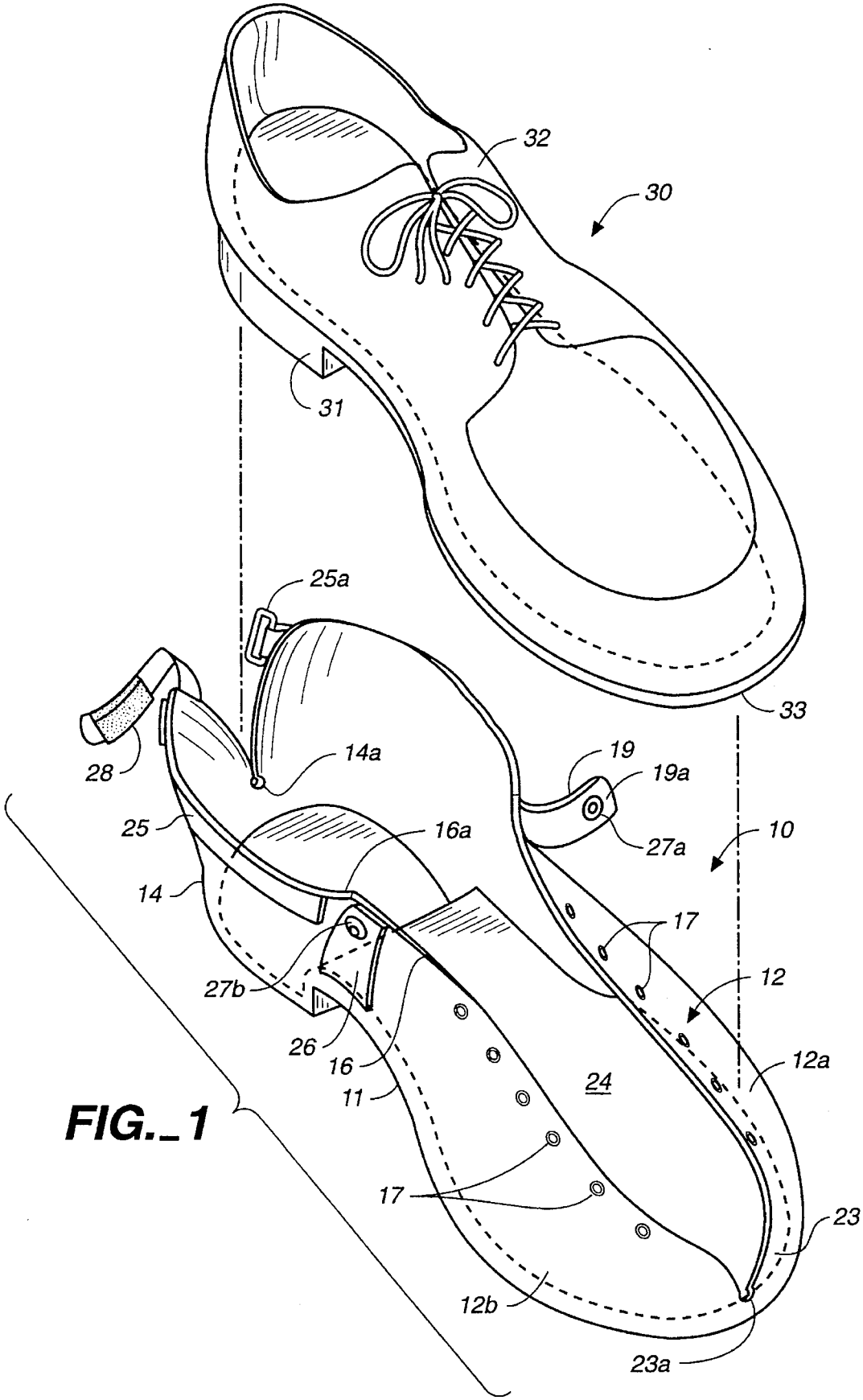
FIG. 1 is an upper frontal exploded perspective view of a dress or sport shoe and the attachment with laces removed for clarity.
Figure 2:
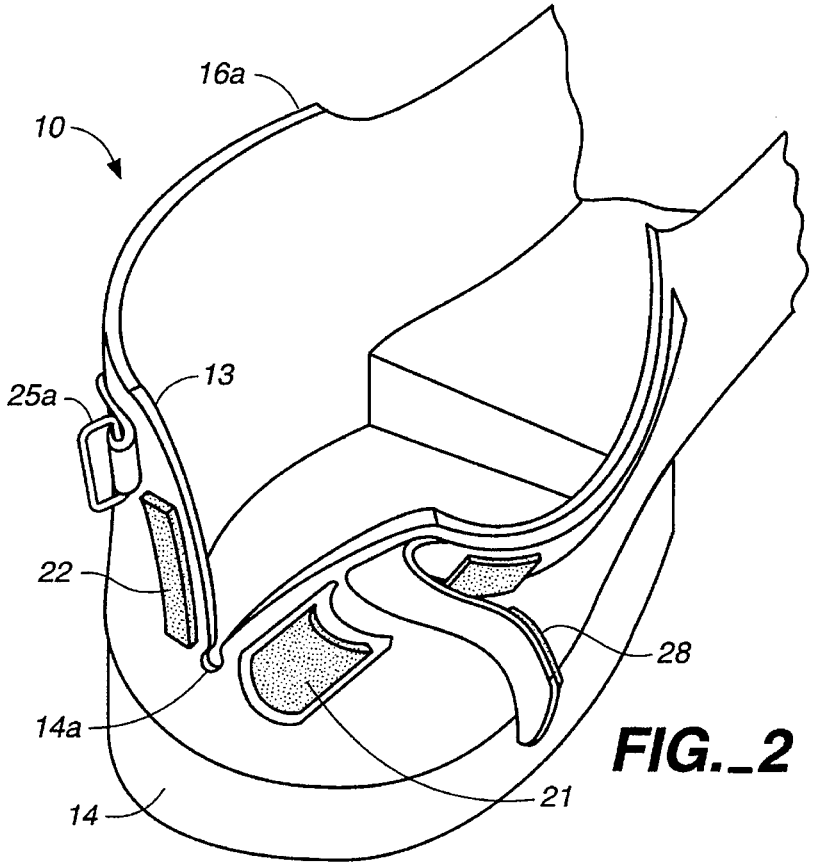
FIG. 2 is a rear perspective view of the attachment heel portion only in an open position.
Figure 3:
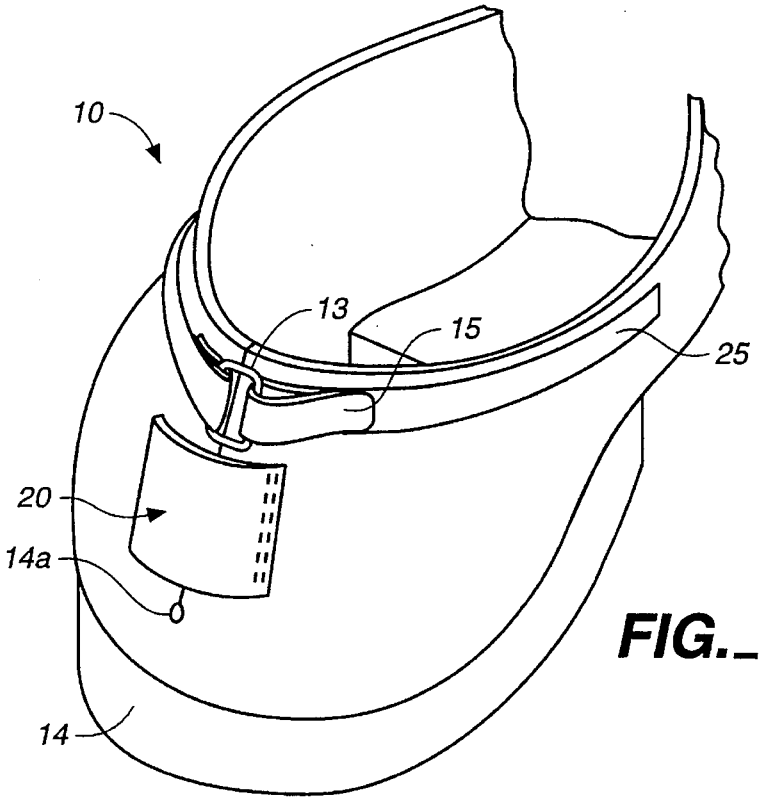
FIG. 3 is a rear perspective view thereof in the closed condition.

In FIG. 1, the spike attachment 10 is shown ready to be mounted on a conventional dress or non-spike sport or athletic shoe 30 having a leather or man-made synthetic material heel 31, shoe upper 32 and shoe sole 33. The attachment 10 is of clam-shell type construction where the shoe attachment side 12 has two sides **12*a* and 12*b* which normally are angularly opened prior to mounting on the non-spiked shoe 30 so they can be closed as a clam-shell to envelop the attachment 10 over substantially all of the exterior of the non-spiked shoe including the entire bottom sole 33, heel 31 and upper 32** thereof.

Figure 4:
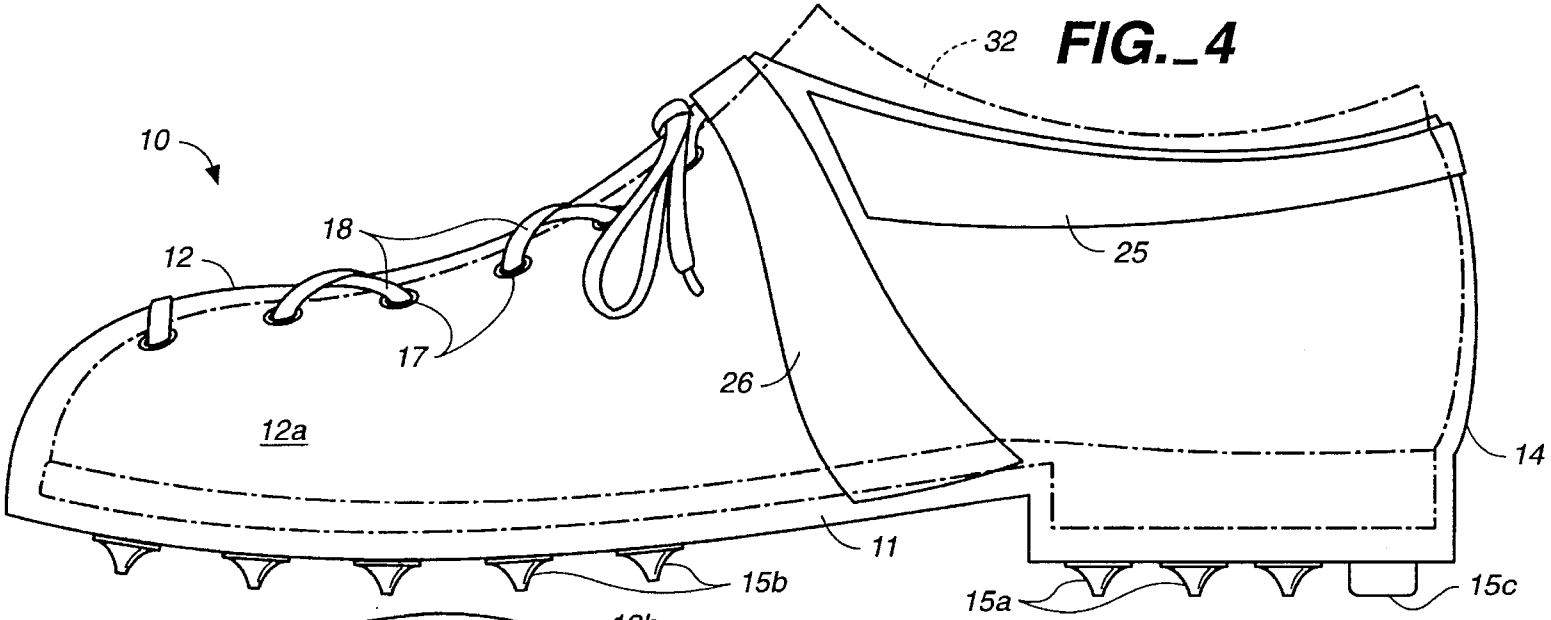
FIG. 4 is a side elevational top view of the attachment installed on a phantom shoe.
Figure 5:
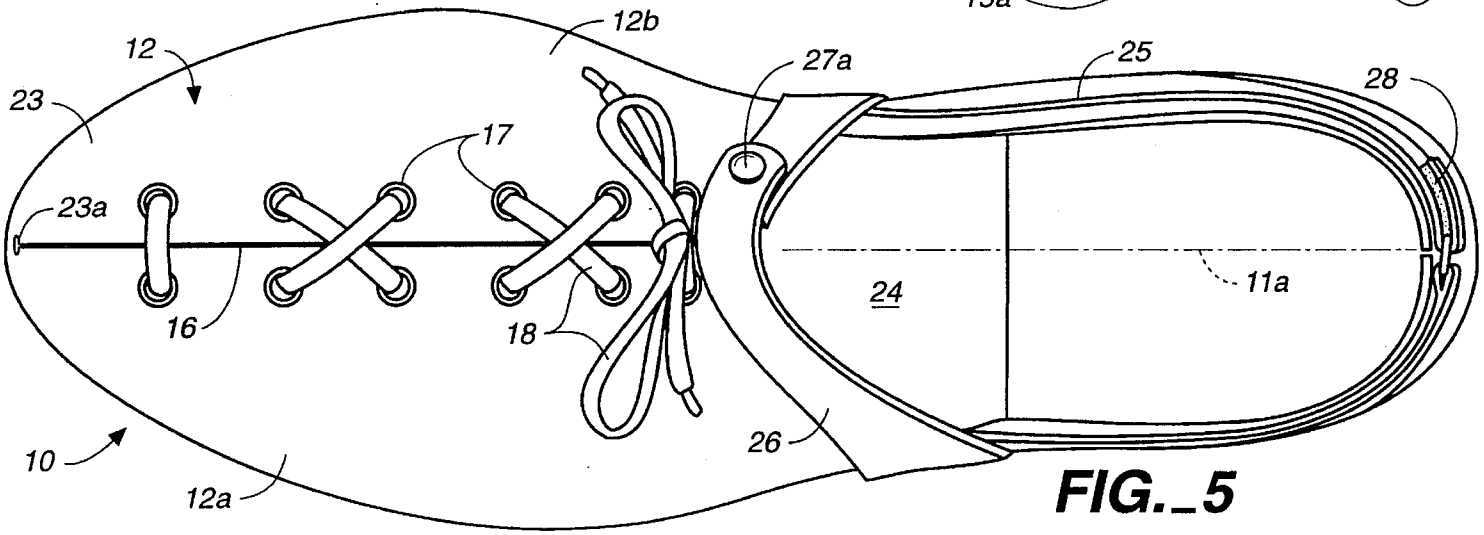
FIG. 5 is a top plan view of the attachment in a closed condition with no shoe present.

The attachment comprises a thin plastic sole 11 of about 3–7 mm in thickness into which are embedded (FIG. 4) an array of golf or other prescribed nylon or metal spikes 15, including spikes **15*a* on a heel 14 of the sole 11 and spikes 15*b* on the front of the sole 11. To illustrate the job site application of the shoe attachment, one of the spikes 15*c* in the heel is shown in FIG. 4. as a cylindrical solid plastic button integrally molded-in place on the attachment sole. In that application, all of the spikes 15*a* and 15*b* would be in the form of a button like spike 15*c*. Likewise, in the golf shoe application, spike 15*c* will be of the type shown by spikes 15*a* and 15*b*. An attachment upper 12 is sewn and/or glued to the sole 11 or the sole and upper are of one-piece construction. The upper 12 includes an instep 16 and toe 23. The two halves 12*a* and 12*b* are pivotable with respect to each other about a pivot area 14*a* at the heel and pivot area 23*a* at the toe so that the attachment can be opened to about a 45°–60° angle sufficient to be placed over the sides and bottom sole of the dress or sport shoe 30. These pivot areas have a rounded terminal end to provide stress relief. This can be done with the shoe on or off the user's foot. The sole 11 has sufficient flexibility in the longitudinal direction or additionally can be scored longitudinally so as to allow bending of the sole about its central longitudinal axis 11***a* (FIG. 5). The top 24 of sole 11 of the attachment will abut the bottom of the sole 33 of the non-spiked shoe 30. The sole 11 also has sufficient transverse flexibility to allow flexing of the sole when walking.

Closures of fasteners 17, 18 best seen in FIG. 5 are provided extending longitudinally of the attachment along a slitted instep 16 extending generally horizontally from the ankle end 16*a* of the instep and preferably extending to the toe pivot end area 23*a*. Fastener 17 may be eyelets and fastener 18 may be laces criss-crossed between the eyelets or may be hook and loop elements, respectively, known also as Velcro®-type fasteners. Likewise, the rear heel fastener 20 may include fastener halves 21 and 22 which extend generally vertically of an attachment heel vertical slit 13 and aligned with the longitudinally axis 11*a* of the attachment. These are preferably hooks and loops elements of a Velcro®-type fastener. The attachment may also incorporate heel strap 15 having the hooks and loops elements 28, the strap being threadable through a cinching loop 25*a*.

Once the attachment 10 is mounted on the non-spiked shoe 30 to generally envelop the shoe 30, each of the fasteners 17/18, 21/22 and 19 are cinched-up and fastened to close the slitted upper and slitted heel and to thus secure the attachment 10 to the now spiked shoe 30. The cinching-up is sufficient so there can be no relative movement of the underlying shoe 30 and the attachment in both normal walking and during the twisting and weight shifting occurring in a golf swing.

As seen in the embodiment of FIGS. 1, 4 and 5, ankle straps 19 and 26 may extend from the sole 11/upper 12 interface. Further, the ankle strap fastener may be another Velcro® fastener or a snap-on button 27*a* on the free-end 19*a* of the strap 19 and a matching button receptacle 27*b* on strap 26.

The sports shoe and attachment can be manufactured and sold as a unit. The attachment can be quickly removed from the dress or sport shoe as one enters his or her car to leave the golf course or is about to enter a non-spikes area of the golf clubhouse. The underlying shoe can be used for any non-golf activity with the attachment easily stored in the user's golf or athletic bag or car trunk. Further, the attachment can be of a more universal size covering a range of men's and women's shoe sizes, the flexibility of the attachment constructional materials allowing the attachment to fit and to be cinched-up to various degrees depending on the size and widths of the enveloped underlying shoe. The attachment may be made of low-weight, durable and thin synthetic leather or of a breathable and flexible plastic, such as nylon or other suitable thermo-plastic. The spikes may be affixed in the attachment sole or soles as taught by the Holt U.S. Pat. No. 2,745,197 or other technique use in golf shoe manufacturing. While the invention has been described in terms of hooks and loops fasteners, laces and eyelet fasteners and snap-on fasteners, zippers may also be used individually or in combination with such other fasteners.

The above description of embodiments of this invention is intended to be illustrative and not limiting. Other embodiments of this invention will be obvious to those skilled in the art in view of the above disclosure.

I claim:

1. An attachment for enveloping a generally flat-soled shoe, the shoe having a non-spiked shoe sole, a non-spiked shoe heel and a shoe upper, said attachment comprising:

a flexible sole and an integral heel portion, each having an array of spikes affixed within a bottom periphery of said flexible sole and said heel portion and depending from said flexible sole and said heel portion;

an integral clam-shell upper extending from the periphery of said flexible sole and said heel portion, said clam-shell upper including a vertically slitted heel and a longitudinal slitted instep portion extending longitudinally with respect to said flexible sole, said upper being pivotally openable to envelop the flat-soled shoe;

a first closure for closing said slitted heel;

a second closure for closing said slitted instep portion;

wherein after said clam-shell upper has been enveloped over the shoe sole, shoe heel and shoe upper of the flat-soled shoe the first and second closures are adapted to be fastened to cinch-up said flexible sole, said slitted heel and said slitted instep portion against the shoe sole, the shoe heel and the shoe upper of the flat-soled shoe;

wherein said slitted instep portion extends from an ankle end of the slitted instep portion to a toe pivot end area of the slitted instep portion;

wherein said claim-shell upper comprises two halves each pivotable about a pivot area of said heel portion and at said toe pivot end area such that said upper can be opened sufficient to be placed over sides of the shoe upper and over the non-spiked shoe sole; and further including a rounded terminal end at each of said areas to provide stress relief.

* * * * *